US007150285B2

(12) United States Patent
Saito et al.

(10) Patent No.: US 7,150,285 B2
(45) Date of Patent: Dec. 19, 2006

(54) CLEANING DEVICE FOR A HAIR REMOVING APPARATUS

(75) Inventors: Atsuhiro Saito, Hikone (JP); Jyuzaemon Iwasaki, Nagahama (JP); Hiroyuki Kameoka, Hikone (JP); Yasuo Ibuki, Hikone (JP); Fumio Taniguchi, Hikone (JP); Kotaro Yanagi, Hikone (JP); Hiroshi Shigeta, Fujiidera (JP)

(73) Assignee: Matsushita Electric Works, Ltd., Osaka (JP)

( * ) Notice: Subject to any disclaimer, the term of this patent is extended or adjusted under 35 U.S.C. 154(b) by 568 days.

(21) Appl. No.: 10/757,445

(22) Filed: Jan. 15, 2004

(65) Prior Publication Data

US 2004/0154650 A1 Aug. 12, 2004

(30) Foreign Application Priority Data

Jan. 21, 2003 (JP) ..... 2003-012809
Jan. 21, 2003 (JP) ..... 2003-012810

(51) Int. Cl.
*B08B 3/04* (2006.01)

(52) U.S. Cl. ..... 134/100.1; 134/111; 134/169 R; 134/186

(58) Field of Classification Search ..... 134/111, 134/100.1, 186, 169 R
See application file for complete search history.

(56) References Cited

U.S. PATENT DOCUMENTS

| | | | | |
|---|---|---|---|---|
| 2,595,838 | A * | 5/1952 | Fuglie | 134/111 |
| 3,172,416 | A * | 3/1965 | Simmons | 134/111 |
| 3,365,267 | A * | 1/1968 | Mekiney et al. | 422/116 |
| 4,054,963 | A * | 10/1977 | Taylor | 15/310 |
| 5,711,328 | A | 1/1998 | Braun | |
| 6,263,890 | B1 | 7/2001 | Hoser | |
| 6,610,819 | B1 * | 8/2003 | Duh et al. | 528/499 |
| 2002/0078984 | A1 | 6/2002 | Hoser et al. | |
| 2002/0170583 | A1 | 11/2002 | Wong | |

OTHER PUBLICATIONS

European Search Report to EP 04 00 0860 dated May 6, 2004.

* cited by examiner

*Primary Examiner*—Frankie L. Stinson
(74) *Attorney, Agent, or Firm*—Rader, Fishman & Grauer PLLC

(57) ABSTRACT

A cleaning device for a hair removing apparatus such as a dry shaver has a basin that receives a shaver head and is supplied with a cleaning liquid for cleaning the head. A single pump is utilized for supplying the liquid from a tank to the basin. The tank is hermetically sealed and is selectively open to the atmosphere by way of an air valve. The valve and the pump are actuated in a controlled manner to selectively give a supply mode for supplying the liquid to the basin from the tank and a recovery mode for recovering the liquid from the basin to the tank.

15 Claims, 14 Drawing Sheets

CLEANING DEVICE FOR A HAIR REMOVING APPARATUS

TECHNICAL FIELD

The present invention is directed to a cleaning device for a hair removing apparatus, particularly a dry shaver with the use of a cleaning liquid.

BACKGROUND ART

U.S. Pat. No. 6,263,890 shows a cleaning device for a dry shaver. The device is formed with a basin for accommodating therein a shaver head of the shaver, and a tank containing a volume of a cleaning liquid and communicating with the basin through a liquid supply channel. A pump is disposed in the liquid supply channel in order to supply the liquid from the tank into the basin for cleaning the shaver head, i.e., cutters and the associated parts. The tank is disposed immediately below the basin for collecting the liquid from the basin by gravity feed. As the tank is required to hold a large volume of the liquid for supplying it to the basin in an amount enough for cleaning the shaver head, the tank is inherently made bulky and therefore adds an extra height to the cleaning device, which detracts from design flexibility.

U.S. Pat. No. 5,711,328 suggests another cleaning device in which the pump is disposed between the basin and the tank in order to feed the liquid back into the tank from the basin and to supply the liquid from the tank to the basin. The tank is itself made as a hermetically sealed container to accumulate the liquid from the basin. When the basin is empty or becomes exhausted, an outside air is introduced into a fluid channel leading from the basin to the tank and is collected also in the tank. The air is accumulated in the tank to give an increased air pressure by which the liquid in the tank is forced to expel into the basin. Thus, the liquid can be constantly circulated between the basin and the tank. With this scheme, however, it is difficult or even impracticable to make the basin completely empty, i.e., to collect the entire liquid from the basin into the tank. That is, as the basin becomes nearly empty, the air is fed into the tank to increase the air pressure which, in turn, expels the liquid out of the tank into the tank. Thus, the basin is always filled with the liquid and could not be totally exhausted by the pump. Consequently, the liquid could not be wholly recovered into the tank and suffers from unintended evaporation until a later cleaning operation.

DISCLOSURE OF THE INVENTION

The present invention has been accomplished in view of the above problems and provides an improved cleaning device for a hair removing apparatus. The cleaning device in accordance with the present invention has a housing configure to hold the hair removing apparatus. The housing is formed with a basin for accommodating therein an operator head of the apparatus, and carries a tank containing a volume of a cleaning liquid. A supplying mechanism is included to supply the cleaning liquid from the tank to the basin for clearing the operator head. The tank has an inlet and an outlet. The inlet communicates with the basin by way of a fluid intake channel that opens to the atmosphere so as to permit the entry of an outside air, while the outlet communicates with a liquid supply channel for dispensing the liquid into the basin. The supplying mechanism includes a pump disposed in either one of the fluid intake channel and the liquid supply channel in order to draw the cleaning liquid from the basin and the air into the tank as well as to supply the cleaning liquid from the tank into the basin. The important feature of the present invention resides in that the tank is in the form of a hermetically sealed container which is selectively open to the atmosphere by way of an air valve, and that the device includes a controller which selectively gives a supply mode for supplying the liquid to the basin from the tank and a recovery mode for recovering the liquid from the basin to the tank. The controller controls to open and close the air valve while actuating the pump, thereby enabling one of the supply mode and the recovery mode, selectively. Due to the provision of the air valve and the controller selectively closing and opening the air valve, the liquid can be recovered successfully into the tank from the basin after cleaning the operator head only with the use of a single pump, leaving substantially no liquid in the basin.

In a preferred embodiment, the pump is disposed in the fluid intake channel to give the supply mode and the recovery mode in association with the control of the air valve. In the supply mode, the controller actuates the pump while keeping the air valve closed so as to feed the air through the fluid intake channel into the tank and accumulate the air pressure within the tank, thereby forcing the liquid out of the tank to the basin under the action of the increased air pressure. In the recovery mode, the controller actuates the pump while keeping the air valve opened so as to collect the liquid out of the basin through the fluid intake channel into the tank without accumulating the air pressure within the tank, thereby collecting the liquid successfully into the tank.

Preferably, the air valve is an electromagnetic valve that closes and opens selectively under the control of said controller.

The device may also include a drip pan that is disposed immediately below the basin to receive the liquid dripping from the basin. The drip pan is open to the atmosphere and is connected to the fluid intake channel such that the cleaning liquid and/or the air are drawn into the tank.

The basin is formed in its bottom with a drain port through which the liquid dribbles into the drip pan together with contaminants dislodged from the operator head. The drip pan is preferably provided with a filter that passes the liquid removed of the contaminants into the tank in order to keep the tank free from the contaminants.

Most preferably, the drip pan is defined by a drawer removably received within a recess in the housing below the basin. The drawer is formed with an opening in fluid communication with the drain port of the basing and with a connection port for detachable connection with the fluid intake channel. The filter being fixed to said drawer at a position between the opening and said connection port. With this arrangement, it is easy to take the contaminants away from a circulating path between the basin and the tank, thereby keeping the liquid clean for prolonged use.

The tank may be detachably mounted on the housing so that it can be washed as necessary or replaced with a fresh one.

The air valve is mounted on the side of the housing and communicates with the tank through an air exhaust channel. The housing is configured to incorporate the fluid intake channel, the air exhaust channel, and a liquid supply channel leading to the basin. While, on the other hand, the tank is integrally formed with an air exhaust tube for detachable connection with the air exhaust channel, a liquid outlet tube extending from the outlet for detachable connection with the liquid supply channel, and a fluid inlet tube extending from the inlet for detachable connection with the fluid intake channel. Thus, the tank can be successfully made detachable to the housing.

The housing is preferred to have a stand giving a mounting face on which the tank is attached. The mounting face is formed at the top end of the housing and includes sockets for detachable connection respectively with the air exhaust tube, the liquid outlet tube, and the fluid inlet tube. The sockets are oriented upwardly with respect to a height axis of the housing such that the tank is mounted on the stand from the above, thereby facilitating the mounding and demounting of the tank, yet avoiding accidental leakage of the liquid possibly remaining in the liquid supply channel and the fluid intake channel on the side of the housing.

Preferably, the tank has in its top end a filling port sealed with a detachable cap in order to replenish the liquid as necessary with the tank mounted on the housing.

In a preferred embodiment, the housing is provided with electrical contact means for connection with an electric circuit of the hair removing apparatus. The electrical contact means is connected within the housing to the controller for transmitting a signal that energizes the hair removing apparatus. Thus, the operator head of the apparatus can be actuated while being exposed to the cleaning liquid for facilitating the cleaning, in addition to that the hair removing apparatus can be charged when it is powered by a rechargeable battery.

In this connection, the housing may include a retainer that holds the apparatus in position for reliable electrical connection between the electrical contact means and the electric circuit in the hair removing apparatus. The contact means includes a plurality of contacts exposed on the exterior of the housing. The retainer is configured to apply a force of pressing the contacts against corresponding terminals formed on the exterior of the apparatus.

Preferably, the basin is provided at the lower end of the housing with respect to the height axis or dimension, while the tank is provided on the housing at a location laterally spaced from the basin in such a relation that the tank overlaps with the hair removing apparatus along the height axis of the housing.

Alternatively, the tank may be shaped to have a vertical section and a horizontal section and a horizontal section. The vertical section is disposed at a location laterally spaced from said basin with respect to said height axis in such a relation that said tank overlaps with the hair removing apparatus along said height axis, and that the horizontal section being disposed below said basin. Thus, the tank can be shaped relatively freely and disposed at a suitable position, improving design flexibility of the device.

Further, the device may be configured to dispose the pump in the liquid supply channel and to dispose the air valve in an air exhaust channel leading from the tank and margining the liquid supply channel at the pump. In addition, a liquid feed valve is disposed in the liquid supply channel between the pump and the tank, and is caused by the controller to open and close selectively in association with the air valve. In this modification, the supply mode is defined to actuate the pump while keeping the air valve closed and at the same time the liquid feed valve opened, thereby drawing the liquid from the tank and supplying it into the basin. On the other hand, the recovery mode is defined to actuate the pump while keeping the air valve opened and at the same time the liquid feed valve closed, thereby vacuuming the tank to draw the liquid out from the basin into the tank without feeding the liquid out of the tank.

These and still other advantageous features of the present invention will become more apparent from the following detailed description of the embodiment when taken in conjunction with the attached drawings.

BEST MODE FOR CARRYING OUT THE INVENTION

Figure 1:
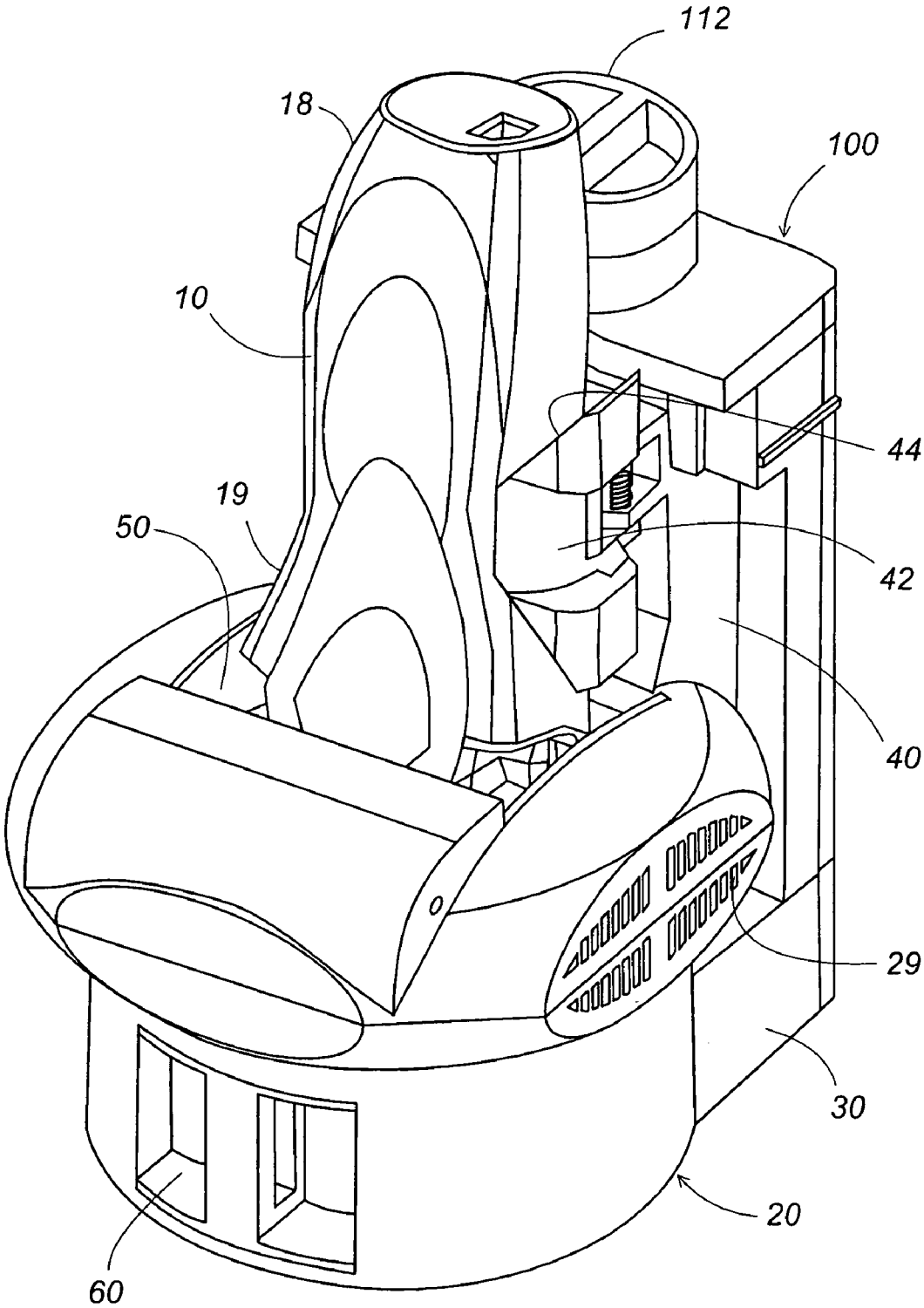
FIG. 1 is a perspective view of a cleaning device shown with a dry shaver in accordance with a preferred embodiment of the present invention.
Figure 2:
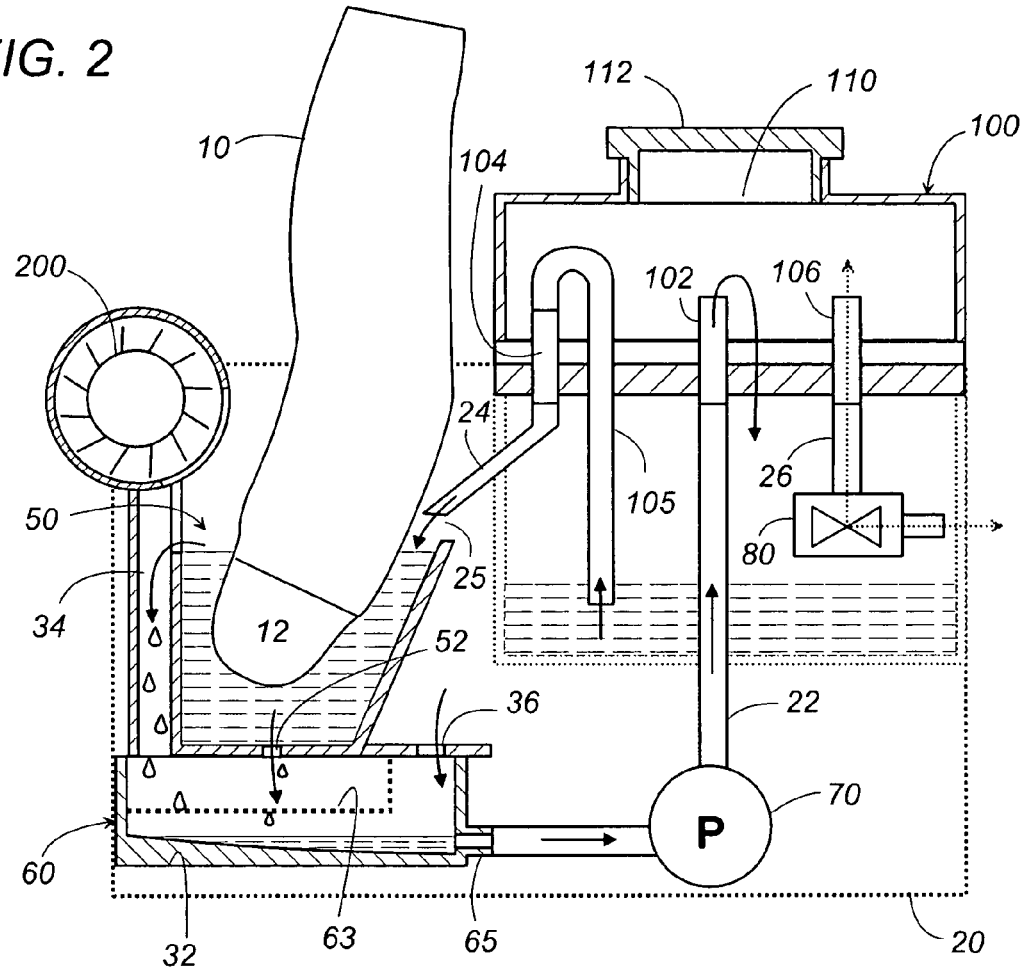
FIG. 2 is a schematic view illustrating the operation of the above device.

Referring now to FIGS. 1 and 2, there is shown a cleaning device for cleaning a hair removing apparatus, for example, a dry shaver 10 or epilator with the use of a cleaning liquid. The device has a housing 20 with a base 30 and a stand 40 upstanding from a rear end of the base. Formed at the front end of the base 30 is a basin 50 which is configured to receive an operator head, i.e., a shaver head 12 of the shaver 10. The cleaning liquid is stored in a tank 100 detachably mounted to the stand 40 and is connected to the basin 50 for supplying the liquid into the basin and for recovering the liquid therefrom. The device includes a pump 70 which is controlled to circulate the cleaning liquid between the tank 100 and the basin 50 for cleaning the shaver head 12. The cleaning operation continues for a predetermined period. Thereafter, a control is made to collect the liquid from the basin 50 into the tank 100, details of which will be discussed later. Upon recovery of the liquid into the tank, a fan 200 is actuated to produce a forced air flow over the head 12 for drying the same.

Figure 9:
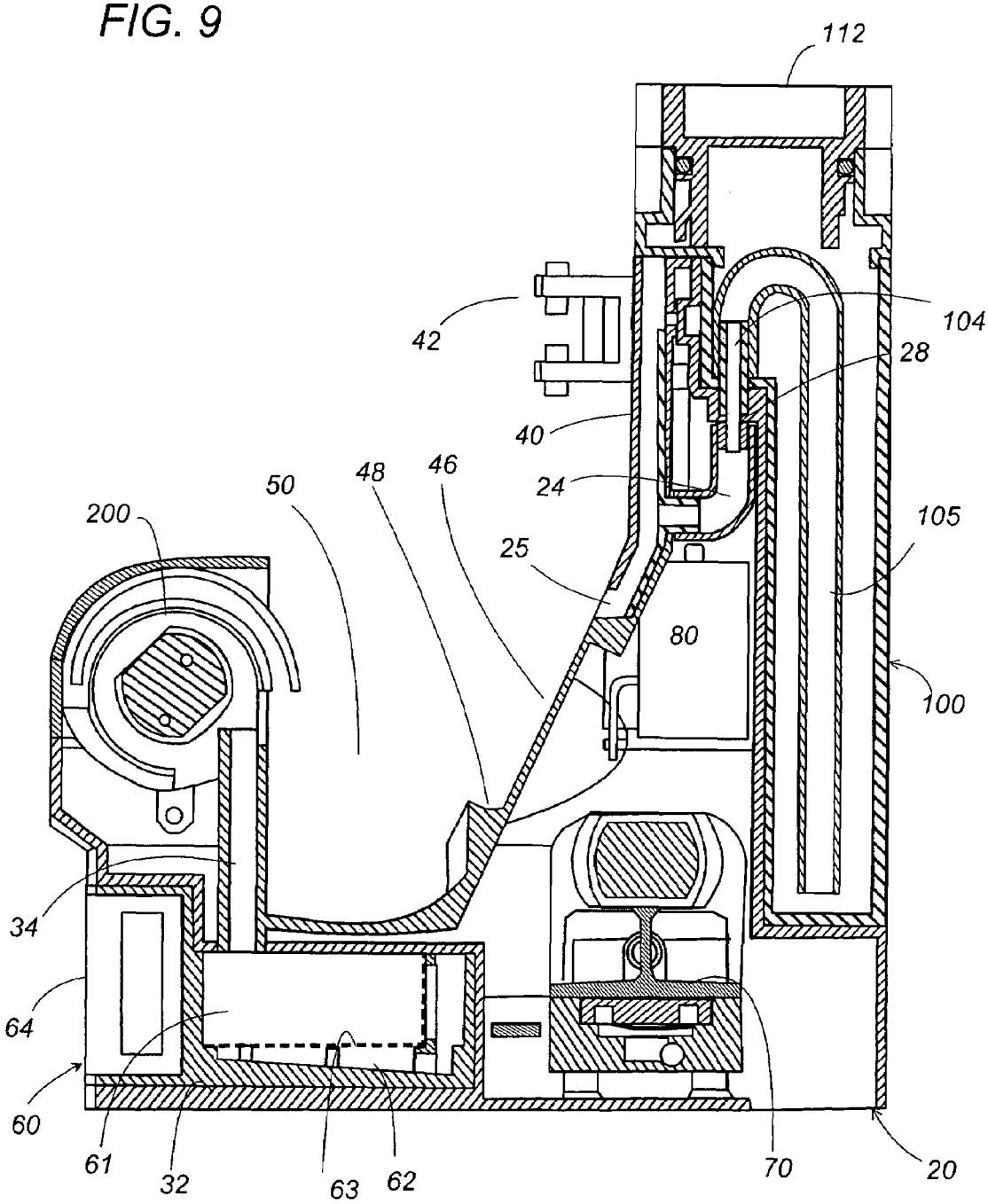
FIG. 9 is another vertical section of the above device.

As shown in FIG. 2, a drip pan 60 is disposed immediately below the basin 50 for collecting the liquid dripping and/or overflowing from the basin 50. The drip pan 60 has a top opening which communicates with a drain port 52 at the bottom center of the basin 50, and also with an overflow duct 34 leading to an upper edge of the basin 50. The drip pan 60 has a filter 63 for entrapping contaminants dislodged from the shaver head 12 and carried on the liquid dribbling through the drain port 52 into the drip pan 60. The liquid thus cleared of the contaminants is fed through a connection port 65 to a fluid intake channel 22 leading to the tank 100. The pump 70 is disposed in the fluid intake channel 22 for drawing the liquid from the basin 50. The fluid intake channel 22 is open to the atmosphere through the drain port 52, the overflow duct 34, and also through an air vent 36 formed in the base 30 around the basin 50. Thus, depending upon the level of the liquid in the basin 50, the outside air is drawn alone or together with the liquid by the action of the pump 70 into the tank 100 through the fluid intake channel 22. The tank 100 is provided in the form of a hermetically sealed container having an inlet and an outlet. The inlet is defined by a fluid inlet tube 102 which is detachably connected to the fluid intake channel 22 for taking in the liquid and/or the air. The outlet is defined by a liquid outlet tube 104 which is detachably connected to a liquid supply channel 24 formed in the housing 20 and leading to a spout 25 upwardly of the basin 50, as best shown in FIG. 9, for flowing the liquid down into the basin 50. Turning back to FIG. 2, the liquid outlet tube 104 is connected to a U-shaped sucking tube 105 which extends deep into the tank 100 to a point adjacent to the bottom of the tank for sucking the liquid. Further, the tank 100 is formed with an air exhaust tube 106 detachably connected to an air exhaust channel 26 which extends within the housing 20 and is open to the atmosphere through ventilation windows 29 or clearances in the walls of the housing 20. An air valve 80 is disposed in the air exhaust channel 26 to selectively close the tank and open it to the atmosphere. The air valve 80 is realized by a normally-closed electromagnetic valve which opens upon being energized or supplied with an electric current. A cap 112 is detachably and sealingly mounted in a filling port 110 in the upper end of the tank 100 for replacing or replenishing the liquid.

Figure 5:
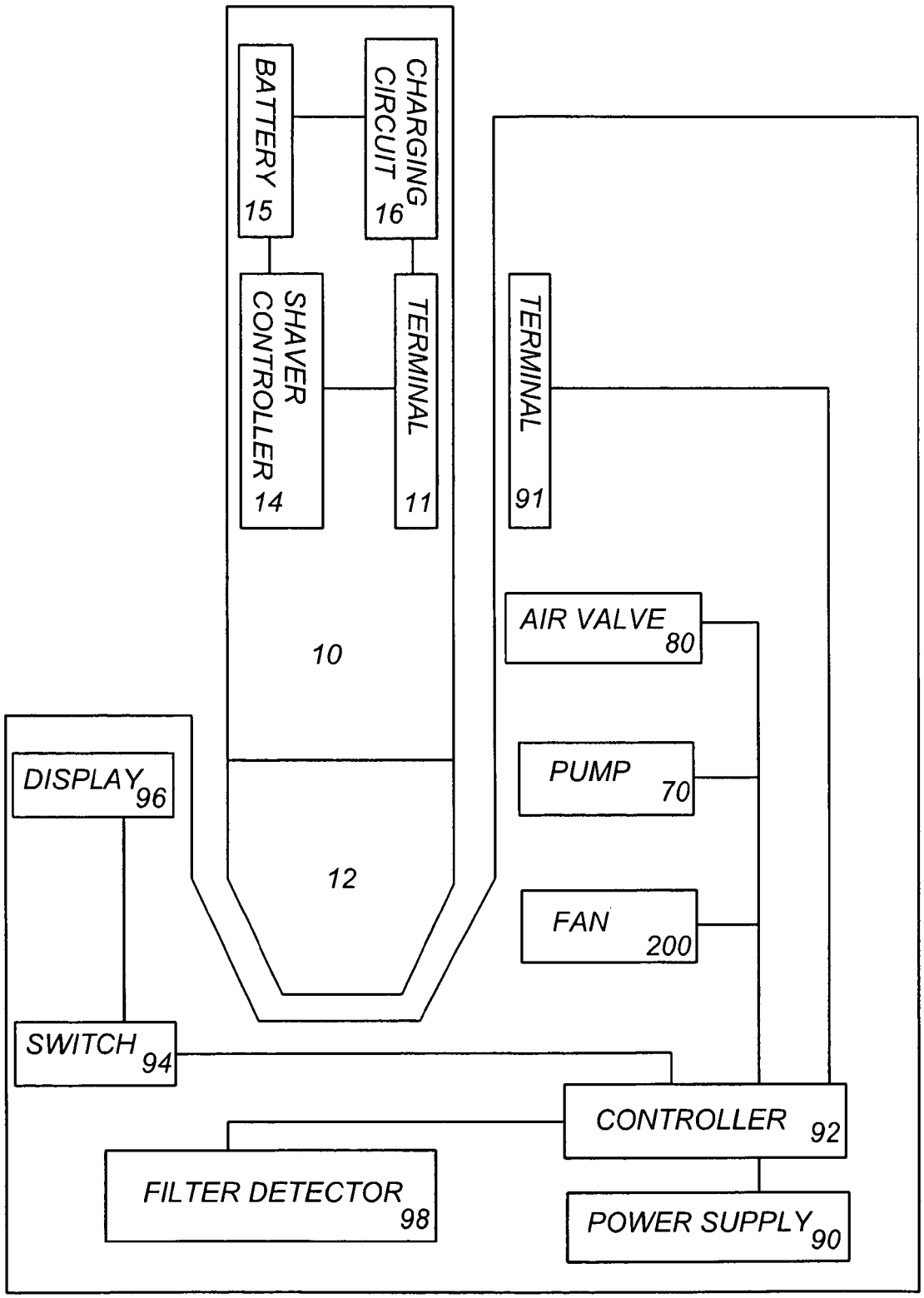
FIG. 5 is a circuit block diagram of the above device illustrating the operation of the above device.

Now, the operation of the device is discussed with reference to FIGS. 2 and 5. The device includes a power supply 90 providing an electric power to various electrical parts, and a controller 92 responsible for controlled operations of the associated parts. When a switch 94 is activated, the controller 92 responds to provide a supply mode and a recovery mode in sequence. In the supply mode, the pump 70 is activated with the air valve 80 being kept closed, i.e., the tank being kept hermetically sealed. Initially, the basin 50 is substantially free from the liquid such that only the air is drawn and accumulated in the tank 100 to increase the inside air pressure. As the air pressure increases, the liquid in the tank 100 is forced to expel out through the liquid outlet tube 104 and the liquid supply channel 24 into the basin 50. In this connection, it is noted that the drain port 52 of the basin 50 is dimensioned such that the flow rate of the liquid dripping into the drip pan 60 is smaller than that of the liquid being supplied from the tank 100, thereby increasing the amount of the liquid in the basin 50. After the basin 50 is filled with the liquid, an extra amount of the liquid is caused to overflow into the drip pan 60, maintaining the liquid in the basin 50 at a constant level. In this connection, the air is continuously drawn into the tank with the superfluous liquid to keep supplying the liquid into the basin 50, i.e., circulating the liquid between the tank 100 and the basin 50 for cleaning the shaver head 12. The supply mode continues over a predetermined time period during which the shaver head is activated intermittently or continuously to shake the contaminants off, enhancing the cleaning effect.

The supply mode is automatically followed by the recovery mode in which the pump 70 is activated with the air valve 80 kept opened to collect the liquid from the basin 50 through the drip pan 60 into the tank 100. With the air valve 80 being opened, i.e., the tank 100 opened to the atmosphere, the air drawn by the pump 70 is exhausted through the air valve 80 so as to recover the liquid and collect only the liquid in the tank 100. The recovery mode continues over a predetermined time period to collect the whole liquid into the tank. Near the end of the period, the shaver head is controlled to be activated for shaking the liquid off. Thereafter, the fan 200 is activated to dry the shaver head with or without the shaver head being actuated. Thus, the supply mode and the recovery mode are accomplished with the use of a single pump and the air valve.

Figure 3:
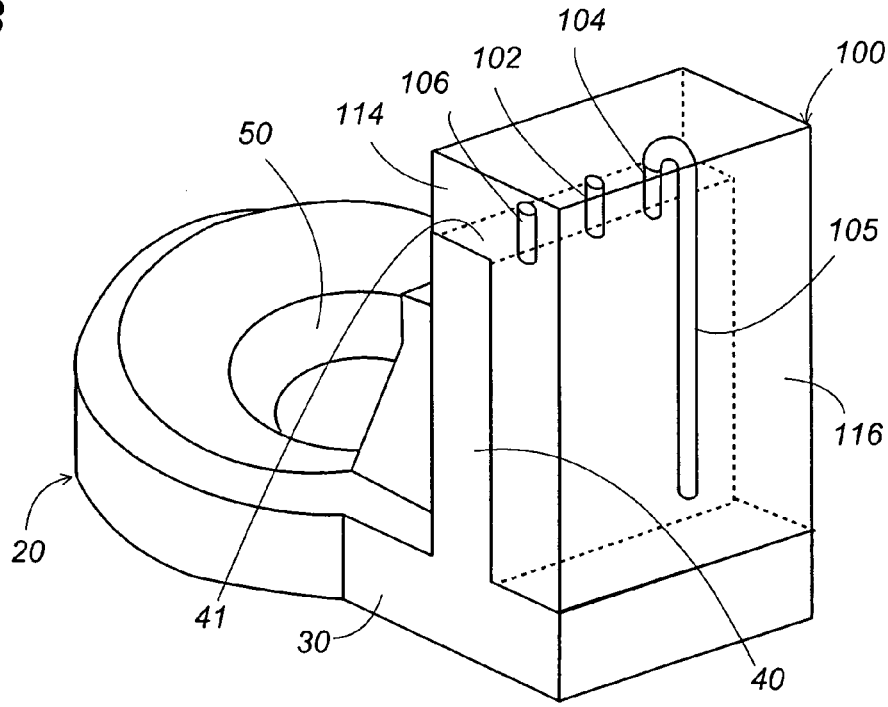
FIG. 3 is a rear perspective view of the above device in a rather schematic representation.
Figure 10:
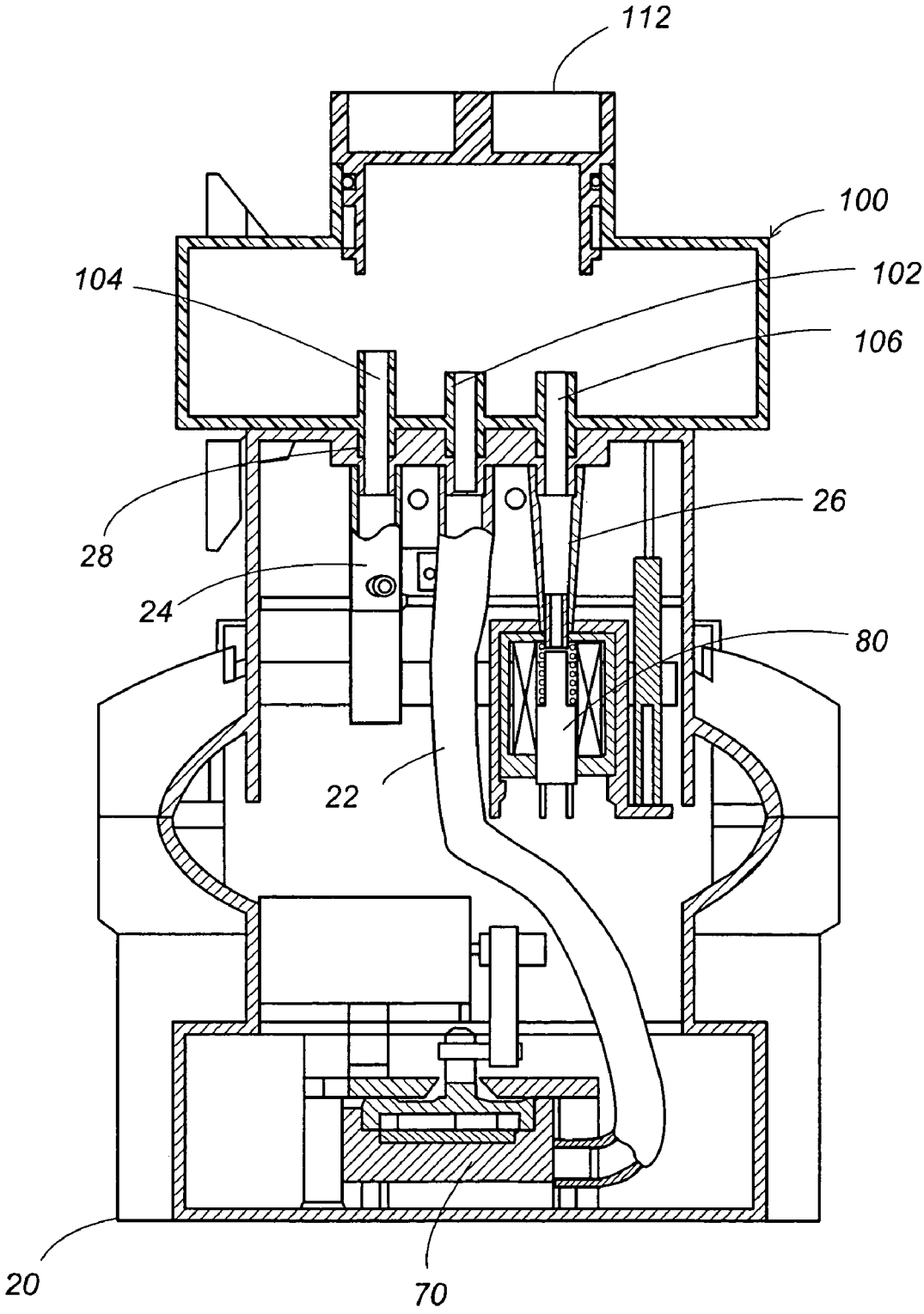
FIG. 10 is a rear vertical section of the above device.
Figure 11:
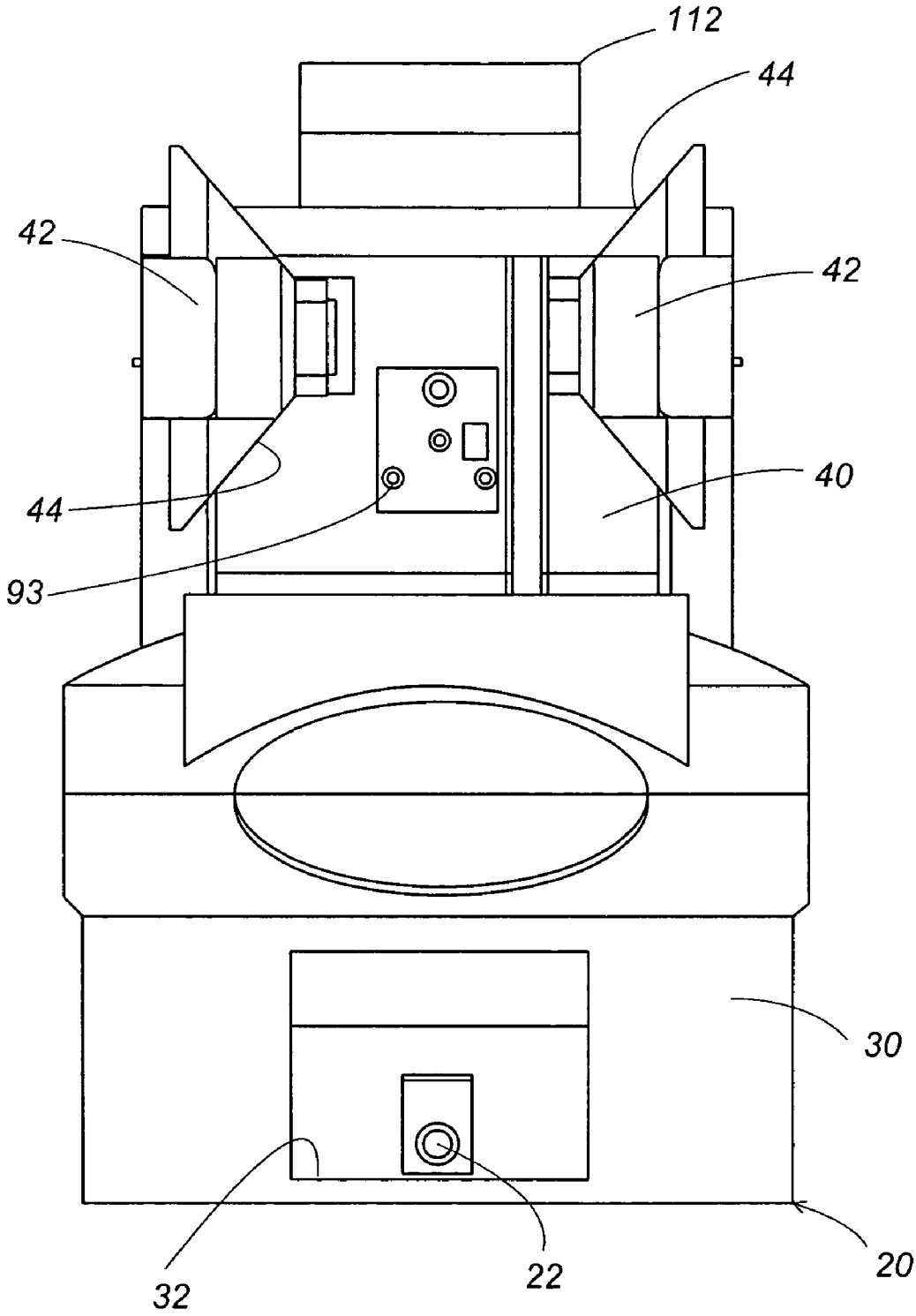
FIG. 11 is a front view of the above device.
Figure 12:
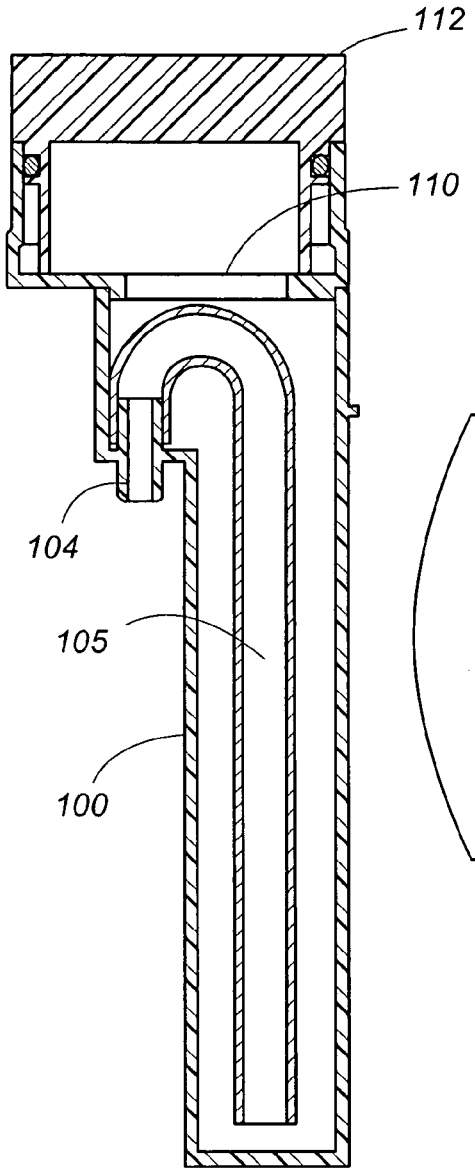
FIG. 12 is a vertical section of a detachable tank utilized in the above device.
Figure 13:
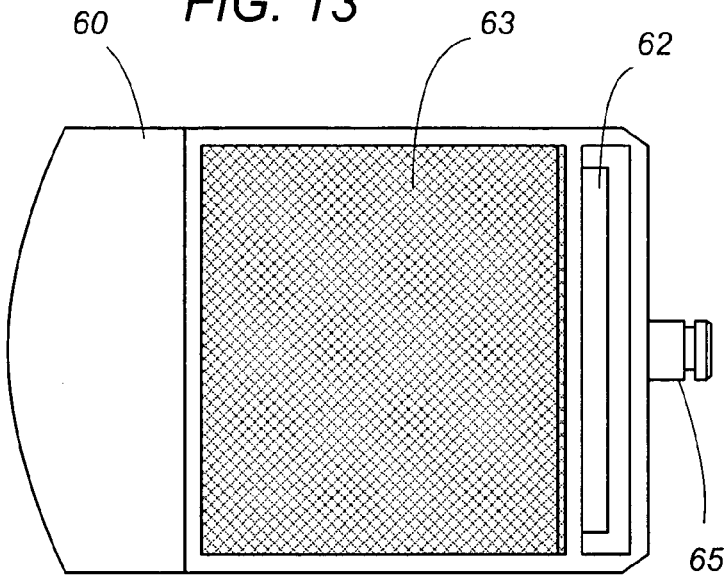
FIG. 13 is a top view of a drip pan utilized in the above device.

As schematically shown in FIG. 3, the tank 100 is L-shaped to have a wide header section 114 and a vertically elongated section 116 overlapping the rear face of the stand 40. The tank 100 is mounted on the housing 20 with the horizontal section 114 resting on a mounting face 41 on top of the stand 40. The fluid inlet tube 102, the liquid outlet tube 104, and the air exhaust tube 106 are integrally formed with the tank 100 to project on the bottom of the header section 114 for detachably connection with the fluid intake channel 22, the liquid supply channel 24, and the air exhaust channel 26, respectively. For this purpose, the ends of the channels 22, 24, and 26 are integrated into a combination socket 28 formed in the mounting face 41, as shown in FIG. 10. Thus, the tank 100 can be attached to the housing 20 from the above.

Figure 6:
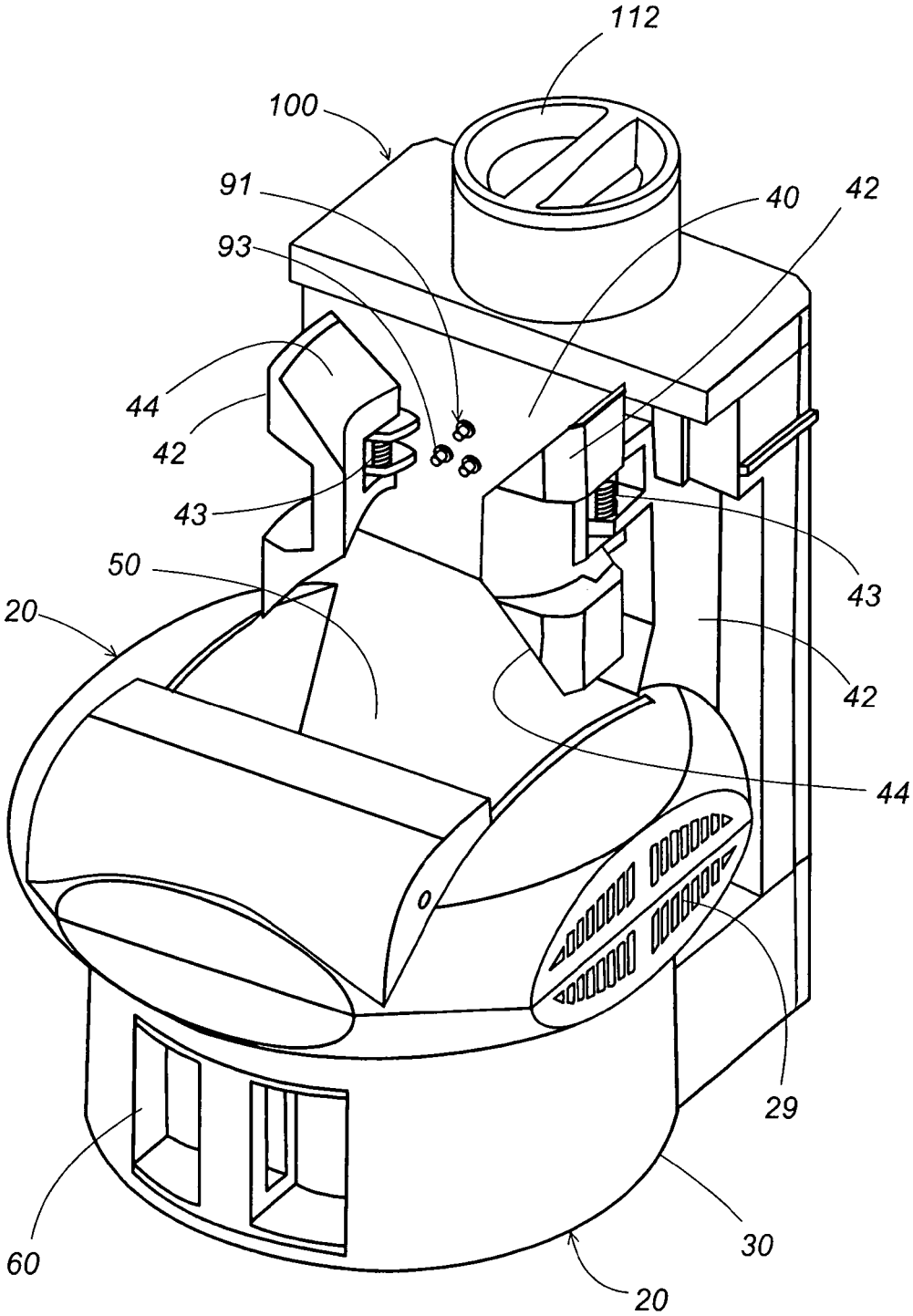
FIG. 6 is a front perspective view of the above device with the dry shaver being removed therefrom.
Figure 7:
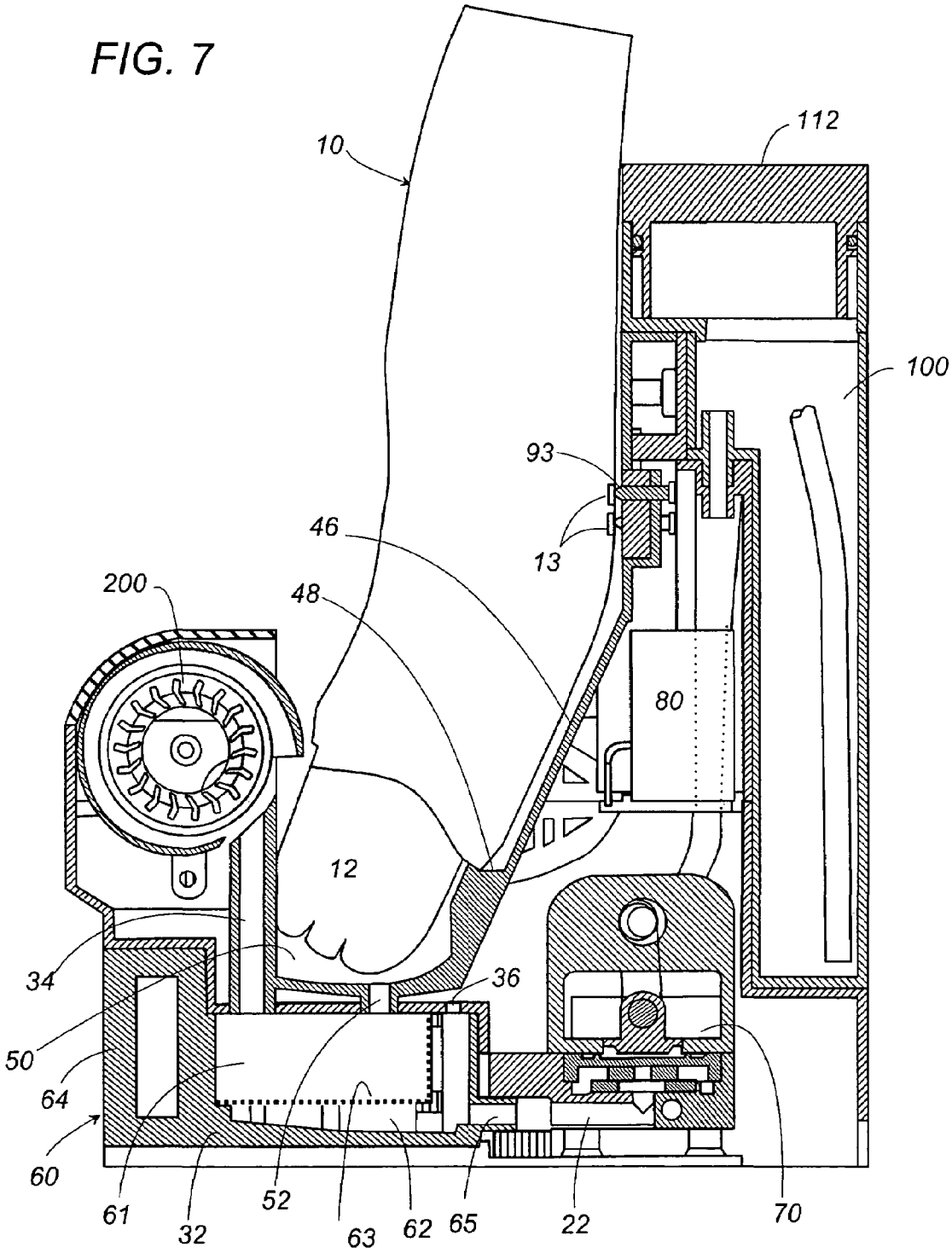
FIGS. 7 and 8 are vertical sections of the above device, respectively with and without the shaver.

The device further includes a filter detector 98 which issues a stop signal when the drip pan 60 is not in position below the basin 50. In response to the stop signal, the controller 92 deactivates the pump 70 and the associated parts to cease the above operation. A display 96 is included in the device to give information about which one of the supply mode and the recovery mode is proceeding, and the elapsed time. Further, a signal transmitting terminal 91 is provided on the side of the housing 20 for transmitting an electric signal that is received in a shaver controller 14 to activate the shaver head 12 or a charging circuit 16 for charging a battery 15. As best shown in FIGS. 6 and 7, the terminal 91 includes a set of contacts 93 exposed on the front wall of the stand 40 for contact with a corresponding set of pads 13 formed on the exterior of the shaver 10. The pads defines a signal receiving terminal 11 represented in FIG. 5 through which the signal is transmitted to the shaver controller 14. The contacts 93, i.e., the terminal 91 is located intermediate the height of the stand 40 for intimate contact with the pads 13 or the receiving terminal 11 when the shaver 10 is held upside down to place the shaver head 12 into the basin 50. Alternatively, the signal transmitting terminal 91 may be in the form of a primary winding for transformer coupling with a secondary winding placed within the shaver as the signal receiving terminal 11. In this modification, both of the windings can be concealed within the housing and shaver, respectively.

Figure 4:
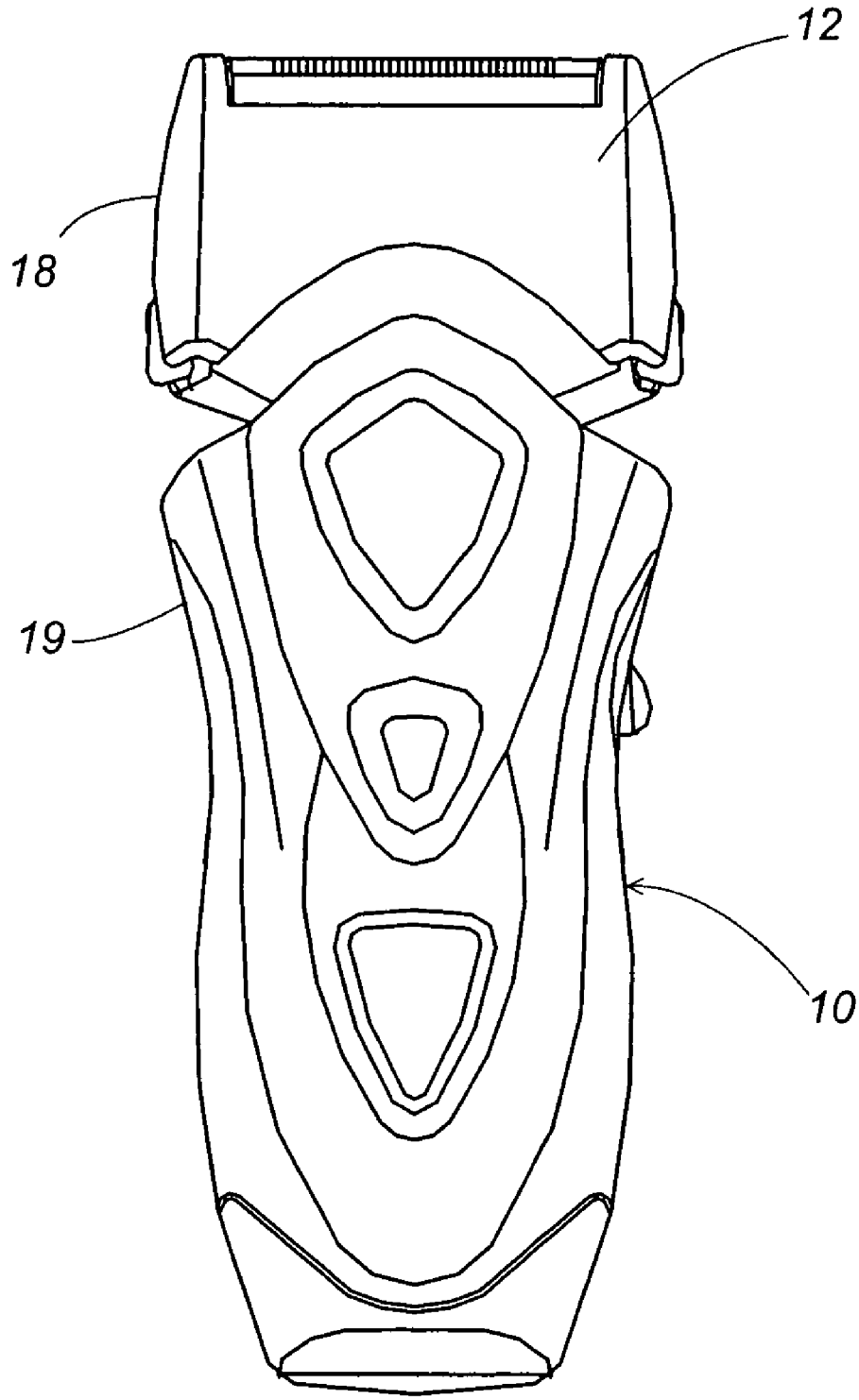
FIG. 4 is a front view of the dry shaver.

As shown in FIG. 6, the stand 40 carries a holding means, i.e., a mechanism of holding the shaver 10 in position. The mechanism includes a pair of clasps 42 which are spaced widthwise with respect to the height dimension of the housing 20 and are pivotally supported to the stand 40 to be movable between a holding position of bracing the shaver 10 and a releasing position permitting the removable of the shaver. The clasps 42 are biased by coil springs 43 to the holding position in which the clasps 42 engage the opposite sides of the shaver 10. Each of the clasps 42 is formed at its upper and lower end respectively with inclined guides 44 for sliding contact with tapered head sides 18 as well as top tapered sides 19 adjacent to the shaver head 12, as shown in FIG. 4. Thus, the clasps 42 can be forced to open temporarily in the release position when the shaver is moved vertically to place the shaver head 12 into the basin 50, allowing the easy attachment of the shaver, after which the clasps close by the action of the springs into the holding position. Also, when the shaver is moved vertically to pull the shaver head 12 out of the basin 50, the clasps 42 are forced to open by contact with the top tapered sides 19 of the shaver, permitting the easy detachment of the shaver from the device. In the holding position, the clasps 42 urges the shaver 10 towards the stand 40 in order to keep the pads 13 of the receiving terminal 11 pressed against the corresponding contacts 93 for reliable signal transmission therebetween.

Figure 8:
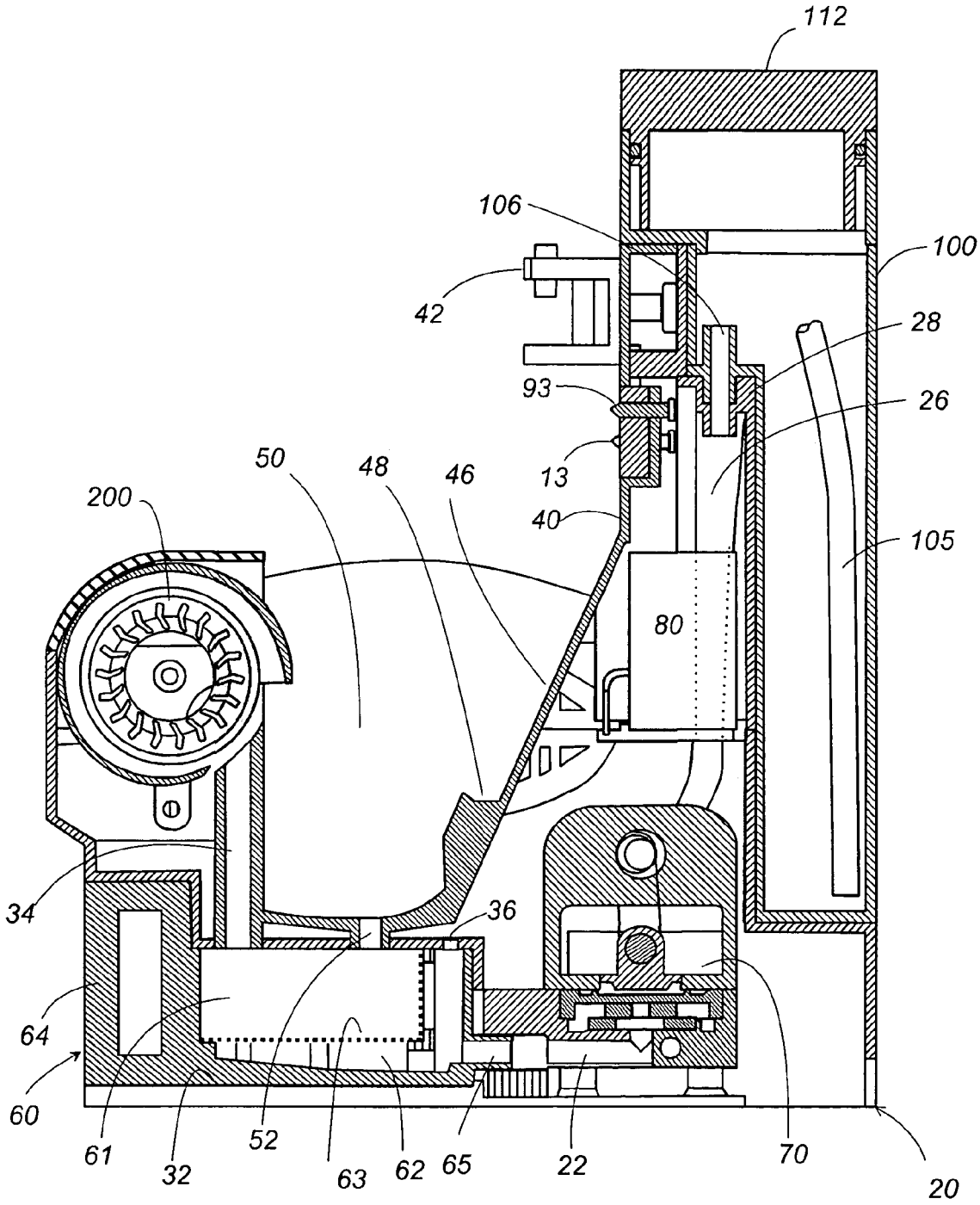

As shown in FIGS. 7 to 9, the stand 40 has a front face which is configured to guide the apparatus 10 to a holding position where the shaver head 12 is received within the basin 50. For this purpose, the front face has is a guide face 46 which is inclined with respect to a vertical or height axis of the housing 20 and which is formed at its lower end with a stopper 48 for abutting against a shoulder of the apparatus or shaver 10. The stopper 48 is positioned so that the apparatus 10 is caused to lean upon the front face of the stand by its own weight, thereby urging the pads 13 of the receiving terminal 11 against the contacts 93 of the transmitting terminal 91 for reliable electrical contact therebetween. In this sense, the electrical connection can be made successfully even without relying upon the springs 43 of the clasps 42.

Figure 14:
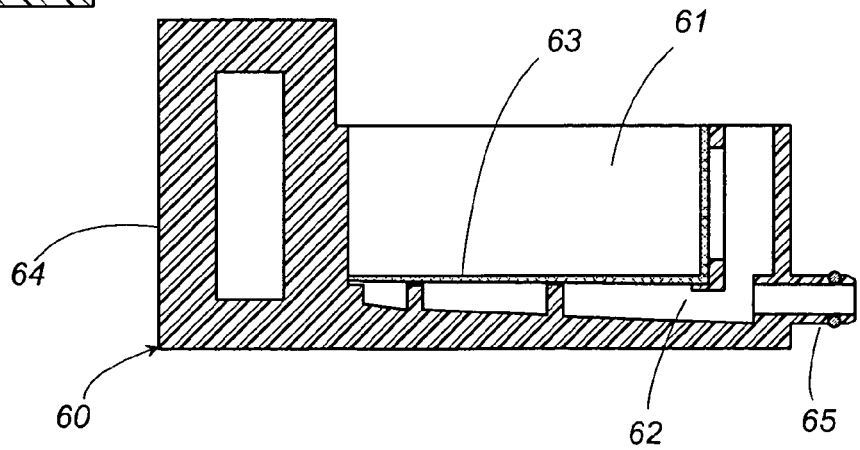
FIG. 14 is a vertical section of the drip pan.
Figure 15:
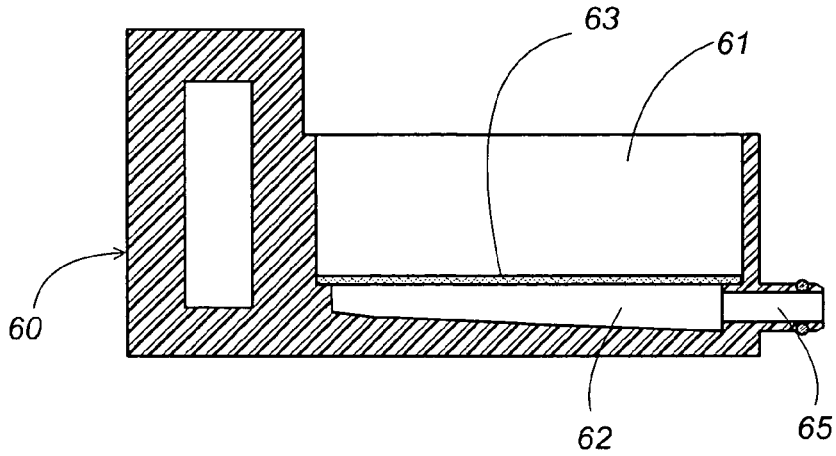
FIG. 15 is a vertical section of an alternative drip pan which may be utilized in the above device.

The drip pan 60 is made detachable to the housing 20 for easy cleaning of the filter 63 as well as the pan 60 itself. As shown in FIGS. 7, 8, and 14, the drip pan 60 is provided in the form of a drawer having a front handle 64 and the top opening which comes into fluid communication with the drain port 52 of the basin 50, the air vent 36, and the overflow duct 34 for receiving the liquid and/or the air therethrough. A recess 32 is formed at the front end of the base 30 immediately below the basin 50 to accommodate the drip pan 60. The inner bottom of the pan 60 is inclined downwardly towards the connection port 65 for smoothly guiding the liquid to the fluid intake channel 22. As shown in FIG. 14, the interior space of the drip pan 60 is divided by the filter 63 into a first chamber 61 and a second chamber 62. The first chamber 61 is in direct open communication with the drain port 52 and the overflow duct 34 for collecting the liquid and/or the air respectively therethrough, thereby depositing the contaminants carried by the liquid on the filter 63. The second chamber 62 is in direct open communication with the air vent 36 and with the connection port 65 for feeding the liquid cleared of the contaminants as well as the outside air into the fluid intake channel 22. For this purpose, the filter 63 is bent into an L-shaped section, as shown in FIG. 14. With this arrangement, the vertical portion of the filter 63 can be located above the level of the liquid in the drip pan 60 so as to entrap the contaminants possibly carried by the air drawn through the drain port 52 in the initial stage of the supply mode as well as in the last stage of the recovery mode. Alternatively, the filter 63 may be made flat, as shown in FIG. 15, so that the second chamber 62 communicates with the air vent 36 through the filter 63. In this modification, the filter 63 can entrap contaminants carried by the air drawn also through the air vent 36.

The pan 60 is formed with an electrode (not shown) which is sensed by the filter detector to determine the presence of the drip pan in the recess 32. In any case, the drip pan 60 is designed to have a liquid storing capacity larger than that of the basin 50 in order to collect the entire volume of the liquid from the basin 50 even if the pump 70 should stop during the supply mode. The filter is preferred to have a filtering area of 700 $mm^2$ or more. Further, instead of providing the removable drip pan 60, the filter 63 alone may be detachable to the housing for frequent cleaning purpose.

Figure 16:
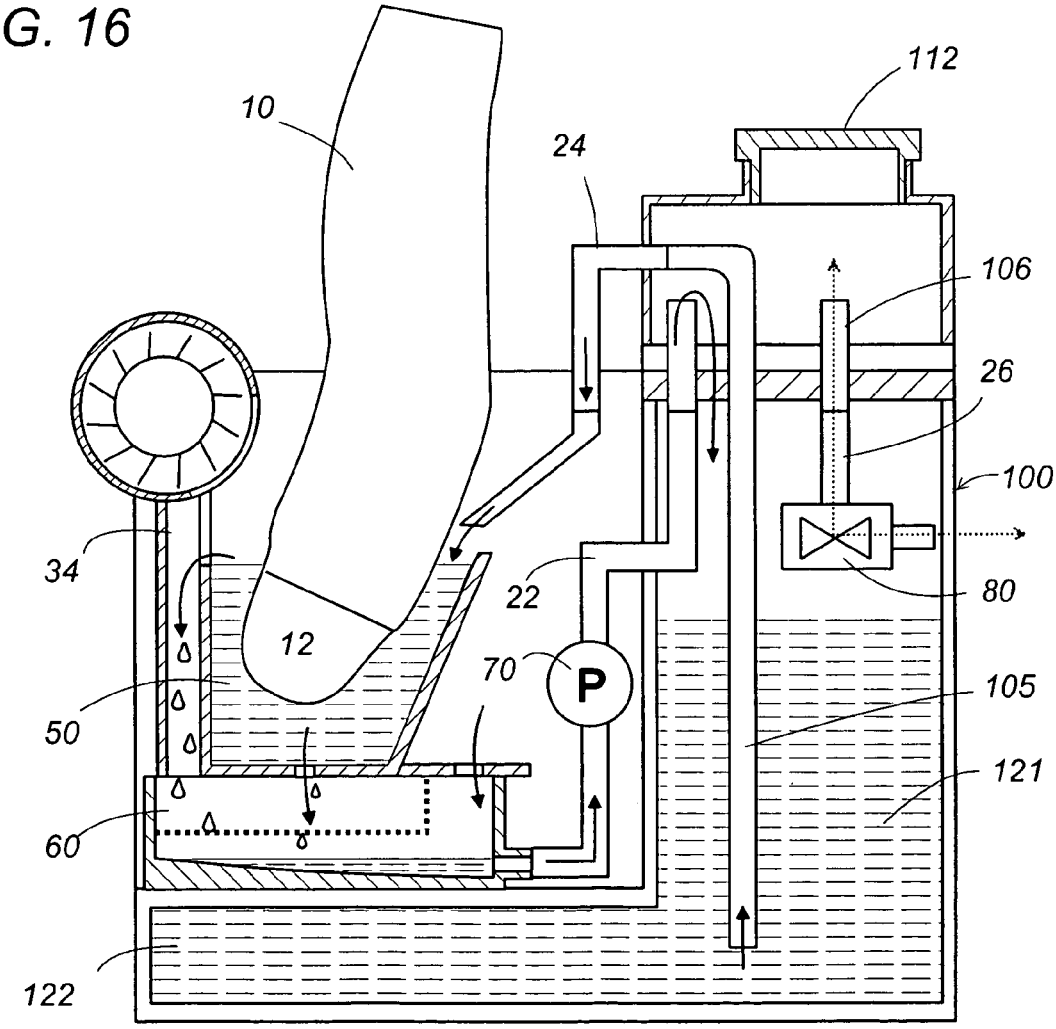
FIG. 16 is a schematic view illustrating a modification of the above device.

In the above embodiment, the tank 100 is spaced laterally from the basin 50 with regard to the height dimension or axis of the housing 20 so as not to add an extra height to the device. However, since the tank 100 can be relatively freely located without regard to the position of the basin 50, it is easy to design the device as shown in FIG. 16, in which the tank 100 is configured to have its major portion, i.e., a vertical section 121 disposed laterally from the basin 50, while locating a horizontal section 122 underneath the drip pan 60. It should be noted that the above spatial arrangements of the tank 100 and the basin 50 are disclosed only for exemplarily purpose, and the present invention should not be interpreted to be limited thereto.

Figure 17:
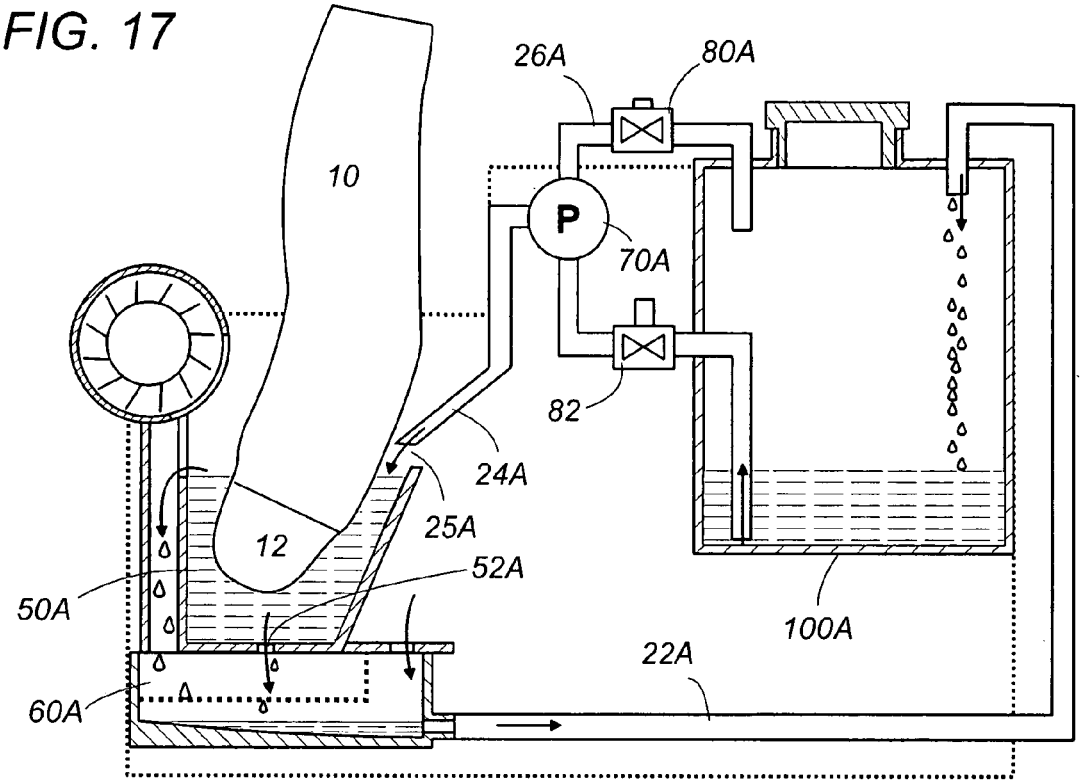
FIGS. 17 and 18 are schematic views illustrating a cleaning device in accordance with another embodiment of the present invention.
Figure 18:
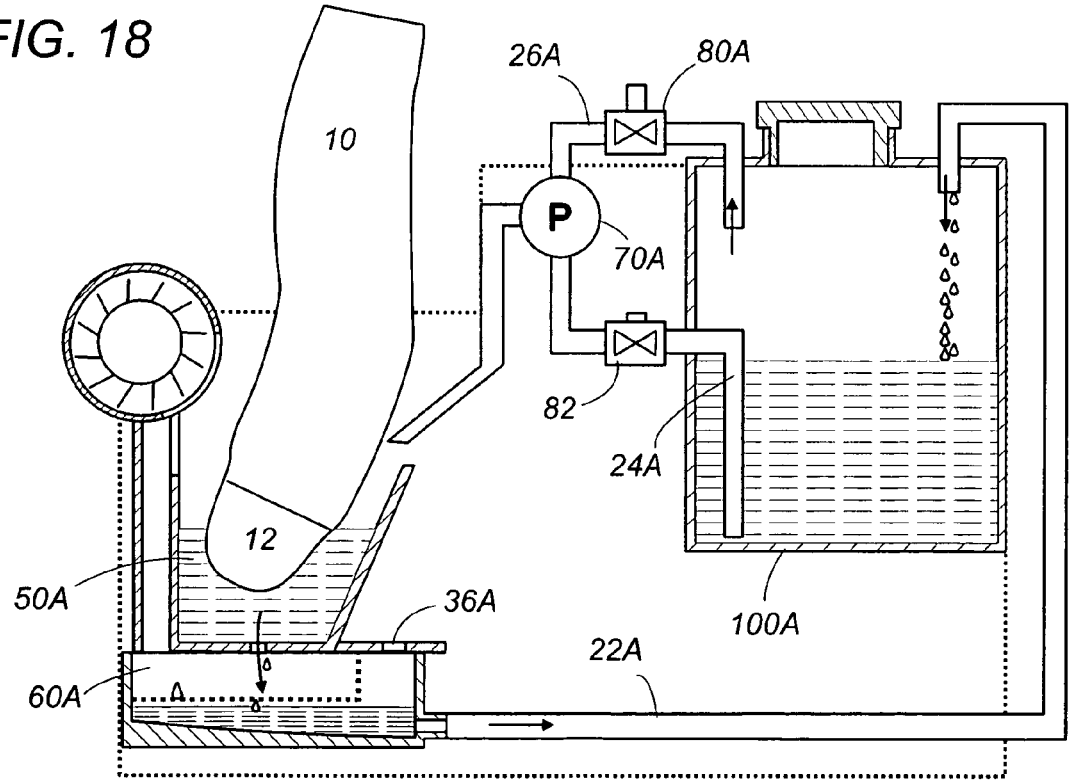
Figure 19:
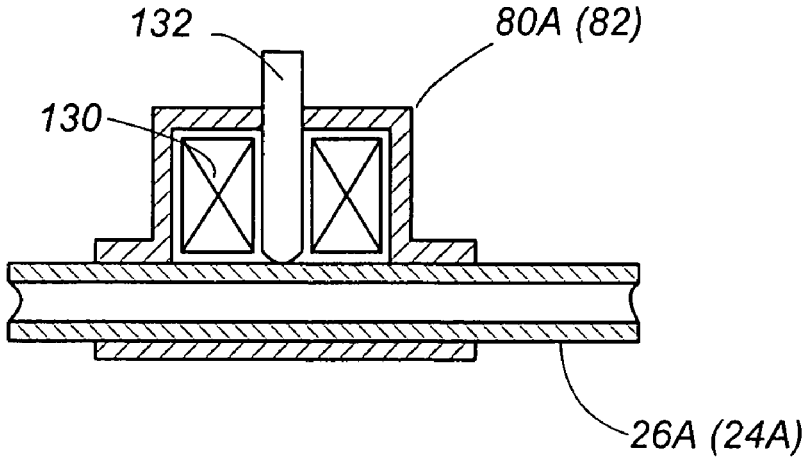
FIGS. 19 and 20 are sectional views illustrating the operation of a valve utilized in the above embodiment.
Figure 20:
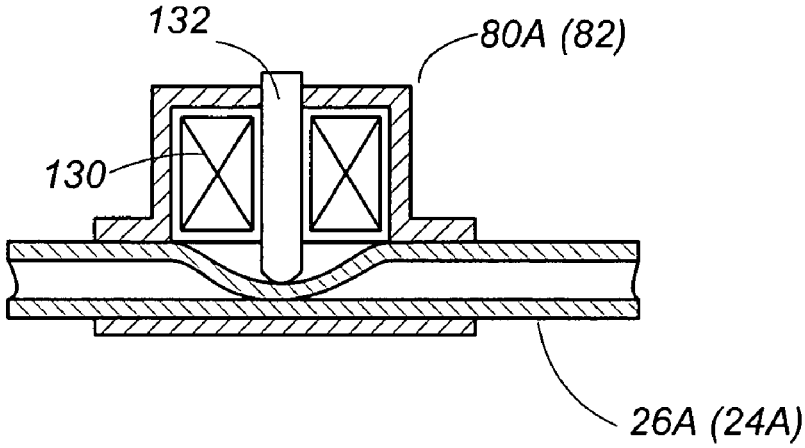

FIGS. 17 and 18 illustrate a cleaning device in accordance with another embodiment of the present invention which is basically identical to the above embodiment except that a liquid feed valve 82 is utilized in addition to the air valve 80A. Like parts are designated by like reference numerals with a suffix letter of "A". The pump 70A is disposed in the liquid supply channel 24A to draw the cleaning liquid out of the tank 100A and supply the liquid into the basin 50A. The liquid feed valve 82 is disposed in the liquid supply channel 24A upstream of the pump 70A for enabling and disabling the liquid feed from the tank 100A into the basin 50A. The air valve 80A is dispose in an air exhaust channel 26A which leads from the tank 100A and merges into the liquid supply channel 24A at the pump 70A, and is therefore open to the atmosphere through the spout 25A at the open end of the liquid supply channel 24A. The liquid feed valve 82 and the air valve 80A are controlled by the controller to be actuated in synchronous with each other to give the supply mode of feeding the liquid from the tank 100A and the recovery mode of collecting the liquid into the tank 100A, selectively. In the supply mode, the air valve 80A is kept closed and the liquid feed valve 82 is kept opened, as shown in FIG. 17, allowing the pump 70A to draw the liquid out of the tank 100A into the basin 50A, while sucking the liquid from the drip pan 60A through the fluid intake channel 22A. In the recovery mode, as shown in FIG. 18, the air valve 80A is kept opened and the liquid feed valve 82 is kept closed. With this result, only the air is expelled by the pump 70A through the air exhaust channel 26A and the liquid supply channel 24A, thereby vacuuming the tank 100A to collect the liquid from the basin 50A through the drip pan 60A and the fluid intake channel 22A. Each of the valves 80A and 82 is in the form of an electromagnetically actuated valve which, as shown in FIGS. 19 and 20, includes an electromagnet 130 and a piston 132 that acts on a flexible tube constituting each one of the channels 26A and 24A for selectively closing and opening the tube or channel by the controller.

The cleaning device in accordance with the present invention can be equally applied for cleaning the epilating head of a hand-held epilator or other operator head of similar hair removing apparatus.

The invention claimed is:

1. A cleaning device for a hair removing apparatus, said device comprising:

a housing being configured to hold said hair removing apparatus;

a basin provided in said housing for accommodating therein an operator head of said apparatus;

a tank containing a volume of a cleaning liquid;

a supplying means that supplies the cleaning liquid from said tank to said basin for cleaning the operator head;

said tank having an inlet and an outlet, said inlet communicating with said basin by way of a fluid intake channel which opens to the atmosphere to permit the entry of an outside air, and said outlet communicating with a liquid supply channel for dispensing the liquid to said basin said supplying means including a pump disposed in one of said fluid intake channel and said liquid supply channel in order to draw said cleaning liquid from the basin and the air into said tank as well as to supply the cleaning liquid from said tank to said basin, wherein said tank is in the form of a hermetically sealed container which is selectively open to the atmosphere by way of an air valve, said device including a controller which selectively gives a supply mode for supplying the liquid to said basin from said tank and a recovery mode for recovering the liquid from said basin to said tank, and said controller controlling to open and close said air valve while actuating said pump, thereby enabling one of said supply mode and said recovery mode, selectively.

2. The cleaning device as set forth in claim 1, wherein said pump is disposed in said fluid intake channel, and said supply mode being defined to actuate said pump while keeping said air valve closed so as to feed the air through said fluid intake channel into said tank and accumulate the air pressure within said tank, thereby forcing the liquid out of said tank to said basin, said recovery mode being defined to actuate said pump while keeping said air valve opened to feed the liquid out from said basin through said fluid intake channel to said tank without accumulating the air pressure within said tank, thereby collecting the liquid into the tank.

3. The cleaning device as set forth in claim 2, wherein said air valve is an electromagnetic valve that closes and opens selectively under the control of said controller.

4. The clearing device as set forth in claim 2, further including a drip pan disposed immediately below said basin to receive the liquid dripping from said basin, said drip pan being open to the atmosphere and being connected to said fluid intake channel such that the cleaning liquid and/or the air is drawn into the tank through said fluid intake channel.

5. The cleaning device as set forth in claim 4, wherein said basin is formed in its bottom with a drain port through which said liquid dribbles into said drip pan together with contaminants dislodged from said operator head, said drip pan being provided with a filter which passes said liquid removed of said contaminants into said tank.

6. The clearing device as set forth in claim 5, wherein said drip pan is defined by a drawer removably received within a recess formed in said housing below said basin, said drawer having an opening in fluid communication with said drain port and having a connection port for detachable connection with said fluid intake channel, said filter being fixed to said drawer at a position between the opening and said connection port.

7. The cleaning device as set forth in claim 2, wherein said tank is detachably mounted on said housing.

8. The cleaning device as set forth in claim 7, wherein said air valve is mounted in said housing and communicates with said tank through an air exhaust channel, said housing incorporating said fluid intake channel, said air exhaust channel, and a liquid supply channel leading to said basin, said tank having being integrally formed with an air exhaust tube for detachable connection with said air exhaust channel, a liquid outlet tube extending from said tank for detachable connection with said liquid supply channel, and a fluid inlet tube extending from said tank for detachable connection with said fluid intake channel.

9. The clearing device as set forth in claim 8, wherein said housing includes a stand having a mounting face on which said tank is attached, said mounting face being formed at the top end of said housing and including sockets for detachable connection respectively with said air exhaust tube, said liquid outlet tube, and said fluid inlet tube, said sockets being oriented upwardly with respect to a height axis of said housing such that said tank is mounted on said stand from the above.

10. The cleaning device as set forth in claim 8, wherein said tank has in its top end a filling port sealed with a detachable cap.

11. The cleaning device as set forth in claim 2, wherein said housing is provided with electrical contact means for connection with an electric circuit of said hair removing apparatus, said electrical contact means being connected to said controller for transmitting a signal that energizes said hair removing apparatus under the control of said controller.

12. The clearing device as set forth in claim 11, wherein said housing includes a retainer that holds said apparatus, said electrical contact means comprises a plurality of contacts exposed on the exterior of the housing, said retainer being configured to apply a force of pressing said contacts against corresponding terminals formed on the exterior of said apparatus.

13. The cleaning device as set forth in claim 1, wherein said housing has a height axis defining therealong a height of said device, and said basin is provided at the lower end of said housing, said tank being provided on said housing at a location laterally spaced from said basin with respect to said height axis in such a relation that said tank overlaps with the hair removing apparatus caught by said housing along the height axis of said housing.

14. The cleaning device as set forth in claim 1, wherein said housing has a height axis defining therealong a height of said device, said tank having a vertical section and a horizontal section, said vertical section being disposed at a location laterally spaced from said basin with respect to said height axis in such a relation that said tank overlaps with the hair removing apparatus caught by said housing along said height axis, and said horizontal section being disposed below said basin.

15. The cleaning device as set forth in claim 1, wherein said liquid supply channel is opened to the atmosphere, and said pump is disposed in said liquid supply channel, said air valve is disposed in an air exhaust channel leading from said tank and margining into said liquid supply channel at said pump, a liquid feed valve being disposed in said liquid supply channel between said pump and said tank and being controlled by said controller to open and close selectively in association with said air valve, said supply mode being defined to actuate said pump while keeping said air valve closed and said liquid feed valve opened, thereby drawing the liquid from the tank and supplying it into said basin, said recovery mode being defined to actuate said pump while keeping said air valve opened and said liquid feed valve closed, thereby vacuuming the tank to draw the liquid out from the basin into said tank without feeding the liquid out of the tank.

* * * * *